US012612746B2

(12) United States Patent
Rusikvas

(10) Patent No.: US 12,612,746 B2
(45) Date of Patent: Apr. 28, 2026

(54) METHOD OF REPAIRING BITUMEN SURFACES AND DEVICE FOR CARRYING OUT THIS METHOD

(71) Applicant: FUTTEC a.s., Prague (CZ)

(72) Inventor: Jiri Rusikvas, Prague (CZ)

(73) Assignee: FUTTEC a.s., Prague (CZ)

( * ) Notice: Subject to any disclaimer, the term of this patent is extended or adjusted under 35 U.S.C. 154(b) by 505 days.

(21) Appl. No.: 18/267,253

(22) PCT Filed: Nov. 29, 2021

(86) PCT No.: PCT/IB2021/061042

§ 371 (c)(1),
(2) Date: Jun. 14, 2023

(87) PCT Pub. No.: WO2022/130079

PCT Pub. Date: Jun. 23, 2022

(65) Prior Publication Data

US 2024/0093440 A1 Mar. 21, 2024

(30) Foreign Application Priority Data

Dec. 15, 2020 (CZ) ..... CZ2020-680

(51) Int. Cl.
*E01C 23/06* (2006.01)
*E01C 7/18* (2006.01)
*E01C 23/14* (2006.01)

(52) U.S. Cl.
CPC ..... *E01C 23/065* (2013.01); *E01C 7/187* (2013.01); *E01C 23/14* (2013.01)

(58) Field of Classification Search
CPC ..... E01C 23/065; E01C 7/187; E01C 23/14; E01C 23/06; E01C 7/22
See application file for complete search history.

(56) References Cited

U.S. PATENT DOCUMENTS 3,870,426 A 3/1975 Kietzman et al.
4,011,023 A 3/1977 Cutler
(Continued)

FOREIGN PATENT DOCUMENTS

CA 1117339 A 2/1982
CN 1058659 A 2/1992
(Continued)

OTHER PUBLICATIONS

CN-110700064-A english translation (Year: 2025).*
(Continued)

*Primary Examiner* — Angelo Trivisonno
(74) *Attorney, Agent, or Firm* — Erise IP, P.A.

(57) ABSTRACT

A device and method for using microwave heating to repair defects in bitumen surfaces. The device identifies a defect in a bitumen layer and divides a region around the defect into a primary heating zone and a secondary heating zone. Microwaves transmitted through waveguides arranged over the primary and secondary heating zones heat the bitumen layer in each zone such that the temperature of the primary heating zone is always 20° C. higher than the temperature of the secondary heating zone. After heating the bitumen layer around the defect, the defect is filled with a pre-heated bitumen mixture compacted until a top surface of the pre-heated bitumen mixture is level with an original surface of the bitumen layer.

6 Claims, 4 Drawing Sheets

(56) References Cited

U.S. PATENT DOCUMENTS

| | | | | | |
|---|---|---|---|---|---|
| 4,175,885 | A | | 11/1979 | Jeppson | |
| 4,252,459 | A | | 2/1981 | Jeppson | |
| 4,252,487 | A | | 2/1981 | Jeppson | |
| 4,276,093 | A | | 6/1981 | Pickermann | |
| 4,319,856 | A | | 3/1982 | Jeppson | |
| 4,347,016 | A | * | 8/1982 | Sindelar | E01C 23/065 126/271.2 A |
| 4,594,022 | A | | 6/1986 | Jeppson | |
| 4,619,550 | A | | 10/1986 | Jeppson | |
| 4,849,020 | A | | 7/1989 | Osborne et al. | |
| 4,856,202 | A | | 8/1989 | Radomsky | |
| 4,957,434 | A | | 9/1990 | Radomsky | |
| 5,083,870 | A | | 1/1992 | Sindelar et al. | |
| 5,092,706 | A | | 3/1992 | Bowen et al. | |
| 5,352,275 | A | | 10/1994 | Nath et al. | |
| 5,441,360 | A | | 8/1995 | Long et al. | |
| 5,810,471 | A | | 9/1998 | Nath et al. | |
| 6,193,793 | B1 | | 2/2001 | Long | |
| 6,571,648 | B2 | | 6/2003 | Bishara | |

FOREIGN PATENT DOCUMENTS

| | | | | | |
|---|---|---|---|---|---|
| CN | 2844202 | | | 12/2006 | |
| CN | 2844210 | | | 12/2006 | |
| CN | 2848928 | | | 12/2006 | |
| CN | 2848929 | | | 12/2006 | |
| CN | 101139811 | A | | 3/2008 | |
| CN | 101235208 | A | | 8/2008 | |
| CN | 201180248 | | | 1/2009 | |
| CN | 101441469 | A | | 5/2009 | |
| CN | 101586326 | A | | 11/2009 | |
| CN | 101774786 | A | | 7/2010 | |
| CN | 105908613 | A | * | 8/2016 | E01C 23/14 |
| CN | 107268402 | A | | 10/2017 | |
| CN | 108252189 | A | | 7/2018 | |
| CN | 110700064 | A | * | 1/2020 | E01C 23/14 |
| CZ | 304810 | | | 11/2014 | |
| CZ | 308031 | | | 11/2019 | |
| DE | 10121929 | A1 | | 1/2002 | |
| DE | 102004004359 | A1 | | 8/2005 | |
| DE | 102009043603 | A1 | | 3/2011 | |
| EP | 0440423 | A2 | | 8/1991 | |
| EP | 1006758 | A1 | | 6/2000 | |
| GB | 2506097 | A | | 3/2014 | |

OTHER PUBLICATIONS

CN-105908613-A english translation (Year: 2025).*

PCT Patent Application PCT/IB2021/061042 International Search Report and Written Opinion issued Mar. 3, 2022.

* cited by examiner

METHOD OF REPAIRING BITUMEN SURFACES AND DEVICE FOR CARRYING OUT THIS METHOD

RELATED APPLICATION

The present application is a national stage application under 35 U.S.C. § 371 of International Application No. PCT/IB2021/061042, filed Nov. 29, 2021, which claims priority to Czechia Patent Application No. PV 2020-680, filed Dec. 15, 2020. The above referenced applications are hereby incorporated by reference.

TECHNICAL FIELDS

The invention relates to the method of repairing bitumen surfaces and to a device for repairing bitumen surfaces with bituminous material, wherein optimum thermal preparation of the repaired pothole and its surroundings is provided by means of a targeted concentration of energy.

BACKGROUND ARTS

Currently, repairs of fissures and potholes on damaged bitumen surfaces are carried out by several methods using several devices. The aim of the repairs is to prevent water from penetrating into and under the bitumen layer and thus protect it from mechanical degradation caused both by changes in the volume of water during temperature changes (below and above 0° C.) and by mechanical dislodging of the aggregate from the layer during water compression by vehicle wheels.

Several methods and devices are known for repairing bitumen surfaces.

Procedure 1

Failures are filled with bitumen binder, either cold-bitumen binder emulsified in water or dissolved in an organic solvent is poured at ambient temperature into a fissure in the bitumen surface, which is also at ambient temperature, or hot-bitumen binder is heated to a temperature where it becomes liquid and is poured into a fissure in the bitumen surface, which is also at ambient temperature.

This method leads to a poor-quality bond between the hardened bitumen binder and the bitumen surface, resulting in a leaky joint and further water infiltration into the damaged bitumen layer. Another disadvantage of this method is the reduced roughness of the road surface at the point where the bitumen binder protrudes onto the road surface, which causes an undesirable and dangerous reduction in the anti-slip properties of the road, especially for single-track vehicles (bicycles, motorcycles).

Procedure 2

The defects are filled with a cold bitumen mixture—a cold bitumen mixture consisting of aggregate in the 4 to 6 mm size fraction and a bitumen binder dissolved in an organic solvent is poured at ambient temperature into the defect in the bitumen surface, which is also at ambient temperature, and then compacted.

This method leads to a poor-quality bond between the cool bitumen mixture and the cold pothole substrate, resulting in a leaky joint and further water infiltration into the damaged bitumen layer. Another disadvantage of this procedure is the reduction of the bearing capacity of the road at the repair site, which is caused by the use of aggregates with a lower grain size and a different fractional distribution than the surrounding road. This procedure is only suitable for use as a temporary provisional repair with a limited lifetime (a few weeks to months).

Procedure 3

The defects are filled with hot bitumen mixture using Spray-Jet device—aggregate with a fraction size of 4 to 6 mm is mixed with bitumen binder heated to a temperature where it becomes liquid and this bitumen mixture is applied at high speed to the defect in the bitumen surface, which is at ambient temperature.

This method leads to a poor-quality bond between the hardened bitumen mixture and the bitumen surface, resulting in a leaky joint and further water infiltration into the damaged bitumen layer. A further disadvantage of this method is the reduction in the slip-resistant properties of the road surface caused by the layer of fine aggregate not bound by the bitumen binder with the repair, which causes both an undesirable and dangerous reduction in the slip-resistant properties of the road surface for all vehicles and the dangerous flying off of the fine aggregate from the wheels of vehicles.

Procedure 4

The defects are excavated and filled with hot bitumen mixture at ambient temperature—the damaged part of the bitumen layer with the defect is cut with a circular saw into a regular square or rectangle shape, the bitumen layer inside the regular shape is mechanically excavated or milled with a road milling machine, the resulting hole in the bitumen layer is covered with a bonding spray of bitumen binder, the hole is then filled with hot bitumen mixture (HRA) and compacted. After the hot bitumen mixture has cooled down, a seam between the embedded bitumen mixture and the original bitumen layer is cut with a circular saw. The cut seam is then treated according to Procedure 1.

This method leads to a poor-quality bond between the hot bitumen mixture and the hardened bitumen binder with the cold bitumen layer, resulting in a leaky joint and further water infiltration into the damaged bitumen layer. Another disadvantage of this method is the reduced roughness of the road surface at the point where the bitumen binder protrudes onto the road surface, which causes an undesirable and dangerous reduction in the anti-slip properties of the road, especially for single-track vehicles (bicycles, motorcycles).

Procedure 5

The bitumen layer in the vicinity of the defect is preheated with a gas flame or IR emitter and filled with hot bitumen mixture—the damaged part of the bitumen layer with the defect is heated into a regular square or rectangle shape with a gas flame or IR emitter. In order to heat the bitumen layer in this manner all the way down to the bottom of the pothole, the surface of the bitumen layer must be heated to temperatures above 190° C. or higher. This causes thermal degradation of the bitumen binder in the heated area and permanent loss of its plastic properties. After the heating is completed, the heated area is mechanically raked, filled with R-material and poured with a quantity of new bitumen binder, mechanically homogenized and then compacted.

This process leads to thermal degradation of the otherwise high-quality bitumen layer in the vicinity of the defect and its replacement with an undefined mixture of R-material and binder. Incorrect estimation of the amount of new binder and inadequate hand homogenization with R-material results in a bitumen mixture with a lack of binder, which quickly suffers from surface erosion and leads to renewal and extension of the defect. Another disadvantage is the development of fumes from the overheated bitumen binder, which is undesirable for the operator from a health point of view, and for the surrounding area of the workplace from an environmental point of view.

Procedure 6

It is known from foreign literature and patent sources that bitumen mixtures and locally damaged road surfaces can be heated by microwave radiation, as indicated for example by American and Chinese patents, but also by Japanese, German, or other patents, as discussed below.

Some patents describe the use of a combination of microwave and conventional, usually gas heating, as claimed in U.S. Pat. Nos. 6,571,648, 4,856,202, 4,252,487, 4,252,459. Most, especially Chinese patents, deal with the design of microwave devices, CN 1011586326, CN 2848929, CN 2848928, CN 2844202, CN 101139811 and a number of others, some in terms of preventing microwave leakage CN 101441469, CN 1011397811, CN 2844210, CN 10158659, DE 10121929 and EP 1006758. The group of patents focused on the recycling of milled bitumen mixture is represented by patents CA 1,117,339, U.S. Pat. No. 4,619,550, CN 101586326, CN 201180248, U.S. Pat. No. 4,011,023.

When using microwave heating, the main problem is usually low absorption of microwaves by the pothole and therefore insufficient heating of the pothole. Bitumen has a very low permittivity ($\varepsilon$=3-5), which further explains its low microwave absorption capacity and thus limited heating capability. Both the bitumen mixture for the repair and the pothole are made up of two components, i.e. bitumen and aggregate. Both of these components are in most cases characterized by low microwave absorption and therefore reduced heating efficiency. Since bitumen is mainly formed by a mixture of high molecular weight hydrocarbons, which are non-polar and therefore have a reduced ability to absorb microwaves, their heating is often inadequate. The patent literature addresses this problem by adding various additives, i.e., additives that have a high microwave absorption capacity and thus are easily heated by microwaves and transfer heat to substances that are difficult to heat. These materials, also called susceptors, are materials that absorb microwave energy by both electric and magnetic fields or both fields simultaneously. The materials described as having the above properties include semiconductors, ferromagnetic materials, metal oxides, metal powders, and others, as evidenced by the following patents. For example, U.S. Pat. No. 4,849,020 and Chinese patent CN 101235208 describe the use of Zn and Fe ferrite, zinc and iron metal powders, chromium, manganese and nickel oxides, silicon carbide, aluminum and titanium oxides, and others. Other additives are described in patent files JP 2104804 (coal), U.S. Pat. Nos. 5,441,360 and 6,193,793 (anthracite coal), U.S. Pat. No. 5,092,706 (Fe304), JP 1178603 (fly ash). A number of other methods and devices for microwave heating of bitumen are described in patents: U.S. Pat. Nos. 4,594,022, 4,175,885, 4,347,016, CA 1117,339, U.S. Pat. Nos. 5,083,870, 4,957,434, 4,276,093, EP 0,440,423, CN 101774786, U.S. Pat. No. 5,352,275, CA 1,117,339, U.S. Pat. Nos. 4,619,550, 4,856,202, 4,252,459, 5,810,471, 4,319,856, 3,870,426, 4,011,023, CN 102009043603, and other, particularly Chinese patents.

The above additives have a beneficial effect on heating, as they transfer the developed heat to the pothole or bitumen mixture. This method, however, is limited to heating bitumen mixture which can be mixed homogeneously with additives throughout its volume before microwave heating. This cannot be done in the case of a pothole in a bitumen layer made from bitumen mix without additive, where the additive can only be applied to the surface of the layer. In this case, it is as problematic to heat as with conventional gas or IR heating. The surface of the pothole is heated to the required temperature of 150 to 160° C., but to an insufficient depth of about 1 to 2 cm, which is insufficient in terms of the quality of the pothole repair. Another disadvantage of some of these additives, such as heavy metals and their compounds, is their health hazards, as they can be released and contaminate the environment when used on roadways.

Although the microwave heating method appears to be more advantageous than conventional heating, it is also limited by the following problems, which hinder its use. Inhomogeneity of the microwave field and thus inhomogeneity of heating, achieving uniform heating of damaged areas, potholes, seams and cracks to the required depth, composition and age of the bitumen pothole having decreasing absorption properties, low absorption of microwaves by the pothole and limited heating possibilities.

It is known that microwave heating produces local temperature gradients in the irradiated material as a result of inhomogeneity of the microwave field or inhomogeneous material, which are larger the smaller the absorption capacity of the irradiated material. Given that the composition of the bitumen and its absorption capacity further decreases with age, a significant amount of up to 50% by weight of active additive is required for the repair. Despite this seemingly advantageous method, it will be appreciated that the heating of the surface of the pothole is insufficient, as it only reaches the aforementioned 1 to 2 cm. Higher temperatures, 170° C. and above, are required for heating to greater depths, which disturbs the structure of the bitumen binder.

The issue of homogenization of surface heating by microwave heating is addressed, for example, by the Chinese patent CN 108252189, which applies the movement of several pairs of magnetrons over the heated surface in two axes parallel to the heated surface. The output of this solution can be a homogeneously heated surface, however, the proposed method of measuring the heating temperature of the bitumen layer raises doubts about the possibility of regulating the heating process, because the heating temperature is derived from the temperature of the magnetron, which seems to be technically unrealistic, because the magnetron must be cooled to prevent its destruction.

The issue of heating depth is addressed by the Chinese patent CN 107268402, which, however, focuses on a different part of bitumen surface repair. This patent addresses the issue of continuous recycling of weathered bitumen layer as opposed to repairing individual defects. It is actually a microwave modification of on-site recycling technologies where the repaired bitumen surface layer is first milled, the milled material is subsequently infiltrated with fresh bitumen binder and then heated by microwave heating at a frequency of 2.45 GHz to a depth of 150 to 200 mm using a main heating plate consisting of a matrix of magnetrons terminated by waveguides. At the same time, the surrounding unmilled layer is heated by two auxiliary heating plates located on two opposite sides of the main heating plate, which are fitted with magnetron arrays with a frequency of 5.8 GHz to a depth of 70 mm. This supports better bonding of the milled and reclaimed material to the unmilled surface on both sides of the milled strip, although the addition of fresh bitumen binder appears to be the main factor in the quality of the bond rather than the heating itself. The energy consumption of such a surface repair and its economic advantage also raises questions.

Procedure 7

The bitumen layer in the vicinity of the defect is preheated by microwave radiation, filled with hot bitumen mixture and compacted—according to the patent CZ 304,810 the area of the defect and its surroundings is covered with a liquid penetrating agent selected from the group of sulphuric acid, phosphoric acid, polyphosphoric acid, the regular area of the defect and its surroundings is heated by the effect of microwave radiation applied e.g. by means of the device according to patent CZ 308,031, to a temperature of 100 to 200° C. to a depth of 2 to 10 cm, covered with a hot bitumen mixture and compacted. The advantage of this process is the heating of the intact part of the bitumen layer to temperatures between 100 and 200° C., where the thermal degradation of the bitumen binder does not occur, but it rather only softens. During compaction, aggregate and binder portions of the hot bitumen mix are intermixed in a waterproof manner into the softened part of the bitumen layer, which, once both portions have set, restores the integrity of the repaired bitumen layer without forming seams, thereby preventing water from entering and under the bitumen layer. The main disadvantage of this process is the use of penetrating agents based on concentrated acids. When microwaves are applied, the concentrated acids are heated to temperatures above 100° C. and oxidize the binder in the bitumen layer, which loses its plasticity. In the immediate vicinity of the original edge of the repaired defect, the aggregate from the bitumen layer subsequently falls out, resulting in a loss of watertightness of the joint and expansion of the area of the original defect. Another disadvantage is the objective danger of concentrated acids—corrosiveness—for the health of the operator. Splashes cause severe skin and eye damage; unintentional ingestion can cause severe oral and gastrointestinal tract damage.

The above methods of repairing bitumen surfaces are related to the deficiencies of the equipment by which they are carried out.

SUMMARY OF INVENTION

The above-mentioned disadvantages of the prior art are largely eliminated by a method of repairing bitumen surfaces and a device for carrying out this method, the essence of which consists in dividing the area around the fault in the bitumen layer into at least two zones prior to heating, with separate heating by the effect of microwave radiation, when in the primary heating zone which is defined by the edge of the defect and its surroundings, which are defined by a distance of at least 10 mm from the edge of the defect on both sides, the bitumen layer is heated to a temperature of between 70° C. and 195° C. (the specific temperature is selected according to the composition of the particular type of bitumen mixture of the bitumen layer to be repaired), and in a secondary heating zone adjacent to the primary heating zone, which is at least 10 mm wide, the bitumen layer is heated to a temperature of between 30° C. and 110° C., where the temperature of the primary heating zone is always at least 20° C. higher than the temperature of the secondary heating zone, and where, after the primary and secondary zones have been heated to the required temperature, the damaged area is filled with the heated bitumen mixture and the bitumen mixture is compacted to a level with the original surface.

A device for carrying out the method includes an application unit comprising a microwave generator and a waveguide thereof, and further comprising a source and a control system, where the microwave generator is coupled to the control unit, wherein the at least two waveguides terminated by an output chamber and coupled to the microwave generator are divided into at least two independent heating segments for controlled heating of a specific area around the defect in the bitumen layer. On the bottom side of the outlet of each of the waveguides of the output chamber there is a sensor for measuring the temperature of the heated surface connected to the control unit. Furthermore, between the casing of the application unit and the frame of the application unit there are drive segments connected to the control unit for controlling the movement of the application unit over the heated surface. The microwave oven for heating the bitumen filling mixture is preferably incorporated into a part of the device separate from the application unit, wherein the separate part includes an internal combustion engine, a generator, a driven and a steering axle. The casing of the application unit may be provided with at least one sensing camera on its underside.

The edge of the bitumen layer defect and its immediate vicinity (primary zone) is heated by microwave radiation to a temperature of 70° C. to 195° C. and the bitumen layer of the secondary heating zone, which is adjacent to the primary heating zone, is heated to a temperature of 30° C. to 110° C., where the temperature of the primary heating zone is always at least 20° C. higher than the temperature of the secondary heating zone, and where, after the primary zone and secondary zone have been heated to the desired temperature, the damaged area is then filled with a hot bitumen mixture of the same type as that used to construct the damaged bitumen layer and compacted to a level with the original surface. Microwave radiation is applied by means of separate heating segments, the power and time of operation of which is controlled for each heating segment independently and separately by means of a control unit.

The division of the damaged bitumen layer surface with the defect into a primary heating zone and a secondary heating zone and their controlled heating to different temperatures eliminates the necessity of using microwave radiation susceptors, while reducing the energy consumption for heating by applying microwave energy only to the areas that must be heated for technological reasons and leaving the rest of the surface unaffected by the microwave radiation.

BRIEF DESCRIPTION OF THE DRAWINGS

The invention will be explained in more detail by means of the drawings, wherein.

DETAILED DESCRIPTION OF THE INVENTION

Figure 1:
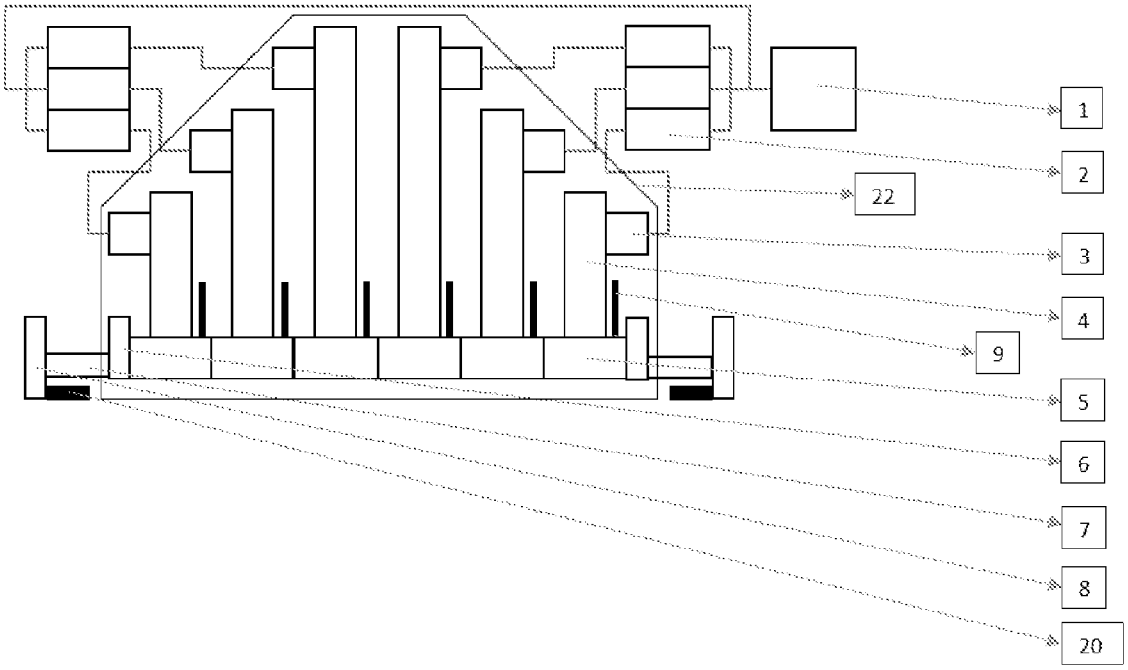
FIG. 1 is a schematic section of the application unit.

The device for repairing bitumen surfaces consists of a drive unit comprising a generator 11. an internal combustion engine 12. a main control system 13. a microwave oven 14 for heating the bitumen mixture, a cooling system 15, a driven axle 16, a steering axle 17, a handle 18 for controlling the steering axle, and a control display 19 with controls, which are connected via a lifting mechanism 10 to a part with the application unit 22. wherein there are further arranged the control unit 1, the power source 2 of the microwave generator 3, the microwave generator 3, the waveguide 4, the output chamber 5, the frame 6 of the application unit 22, the drive segment 7, the casing 8 of the application unit 22. the temperature measurement sensor 9, the sensing camera 20.

The electric generator 11 generating 3-phase voltage 230 V/50 Hz is connected to the diesel engine 12. The voltage is fed through the switchboard and fuse box to the power source 2 of the microwave generator 3, which consists of a high voltage transformer producing a voltage of 4000 V/5 kHz. This voltage supplies the microwave generators 3 with the power of 1 kW. Start-up of power sources 2 and regulation of their power is controlled by the control unit 1 according to the data from the temperature measurement sensors 9 and from the information entered by the operator on the control display 19. where the operator defines the primary heating zone 25 on the image from the sensing cameras 20. Based on the definition of the primary heating zone 25, the control unit 1 automatically defines the secondary heating zone 26.

Figure 2:
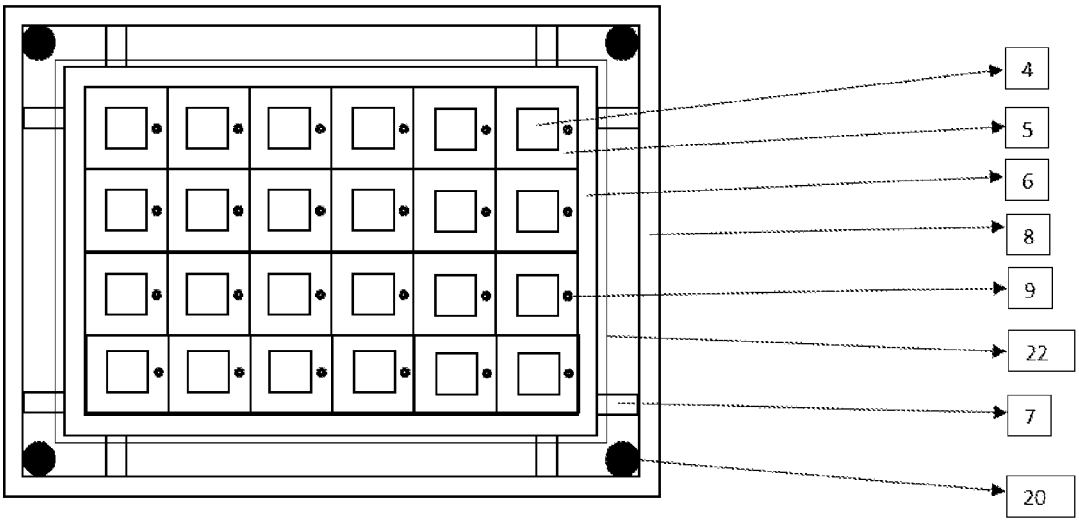
FIG. 2 shows a view of the underside of the application unit.
Figure 3:
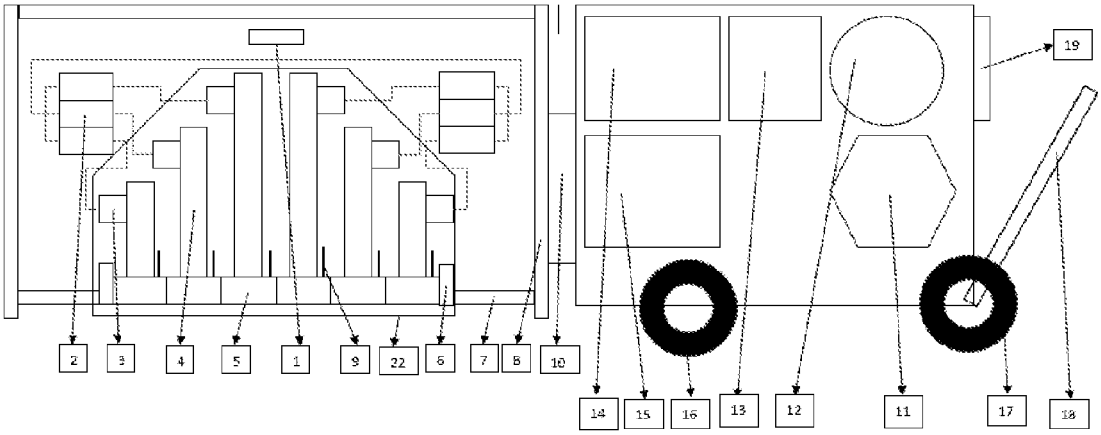
FIG. 3 shows a schematic section of the entire device including its drive and service unit.
Figure 4:
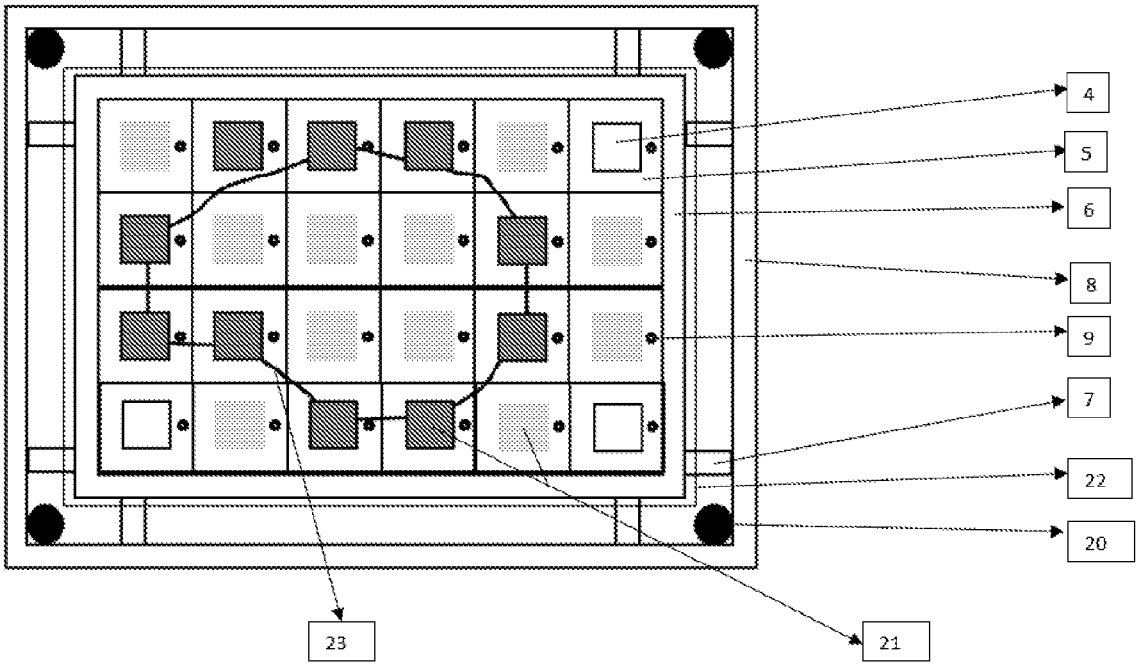
FIG. 4 shows the marking of the zones on the underside of the application unit.

The microwave generators 3 are mounted to aluminum waveguides 4. The waveguides 4 form a rectangular matrix (FIG. 2), with a stainless-steel lattice at the bottom, each segment of which forming one output chamber 5. A stainless-steel tube ensuring microwave attenuation is inserted into the output chamber 5 and a pyrometer—temperature measuring sensor 9 is placed at its upper end. The signal from the temperature measuring sensor 9 is fed to the control unit 1.

The waveguide 4 matrix is circumferentially clamped by frame 6 of application unit 22. Between the frame 6 and the casing 8, drive segments 7 consisting of rubber air bags are placed.

The rubber bags are connected to a pressure air distribution system fitted with electronically controlled air valves. These air valves are controlled from the control unit 1 so as to move the entire matrix of waveguides 4 in the transverse and longitudinal direction at the time of heating, thereby homogenizing the heating of the bitumen layer. Pressurized air is produced by a reciprocating compressor and stored in an air tank—both located at the combustion engine 12.

The sensing camera 20 is placed on the casing 8. The sensing camera 20 transmits the image of the road surface to the control unit 1, which displays it on the control display 19 and allows the operator to guide the machine to the defect and subsequently define the primary heating zone 25.

Boxes with power sources 2 which are cooled by air blown into the boxes by a fan are placed above the waveguides 4.

The casing 8 is attached to a steel lifting mechanism 10, which is lifted by an electrically driven screw lifting mechanism.

The microwave oven 14 for heating the bitumen mixture consists of a stainless-steel chamber into which the waveguides 4 are inserted. The microwave generators 3 are placed at their upper end. As with the application unit 22, the microwave generators 3 are powered from the power source 2, which consists of a high voltage transformer producing a voltage of 4000 V/5 kHz, to which the voltage of 230 V/50 Hz from the electrical generator 11 is fed via a switchboard and fuse box. The microwave oven 14 for heating the bitumen mixture is equipped with a stainless-steel door with integrated microwave shielding.

The chassis of the device is provided with two separate electrically driven wheels forming a driven axle 16, and one steering wheel forming a steering axle 17 which is not driven is provided at the front of the chassis. This steering axle 17 is attached firmly to the control handle 18. The control handle 18 contains manual controls that control the driven axle 16. The device direction of travel is controlled mechanically by turning the control handle 18. At the front of the machine, above the control handle 18, there is a control unit 1 with a control display 19 with controls. The operator uses the control display 19 and the control unit 1 to transmit instructions to the device and to obtain information about the status of the device.

The device operated in such a way, that the edge of the bitumen layer defect and its immediate vicinity forms the primary zone 25 that is heated by microwave radiation to a temperature of 70° C. to 195° C. and the secondary heating zone 26, which is adjacent to the primary heating zone 25. is heated to a temperature of 30° C. to 110° C., where the temperature of the primary heating zone 25 is always at least 20° C. higher than the temperature of the secondary heating zone 26, and where, after the primary zone 25 and secondary zone 26 have been heated to the desired temperature, the damaged area is then filled with a hot bitumen mixture of the same type as that used to construct the damaged bitumen layer and compacted to a level with the original surface. Microwave radiation is applied by means of separate heating segments, the power and time of operation of which is controlled for each heating segment independently and separately by means of the control unit 1.

The division of the damaged bitumen layer surface with the defect into a primary heating zone 25 and a secondary heating zone 26 and their controlled heating to different temperatures eliminates the necessity of using microwave radiation susceptors, while reducing the energy consumption for heating by applying microwave energy only to the areas that must be heated for technological reasons and leaving the rest of the surface unaffected by the microwave radiation.

Example 1—Pothole

Figure 7:
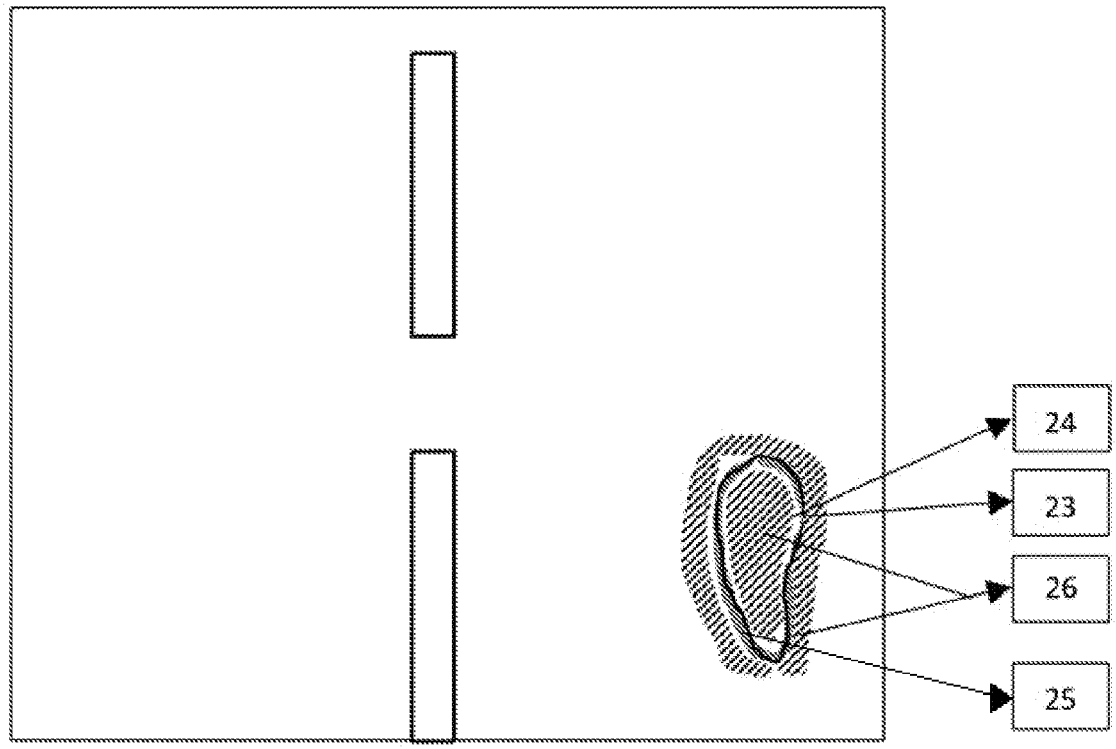
FIG. 7 represents a road surface with a major pothole failure showing the top view of the heating zone.
Figure 8:
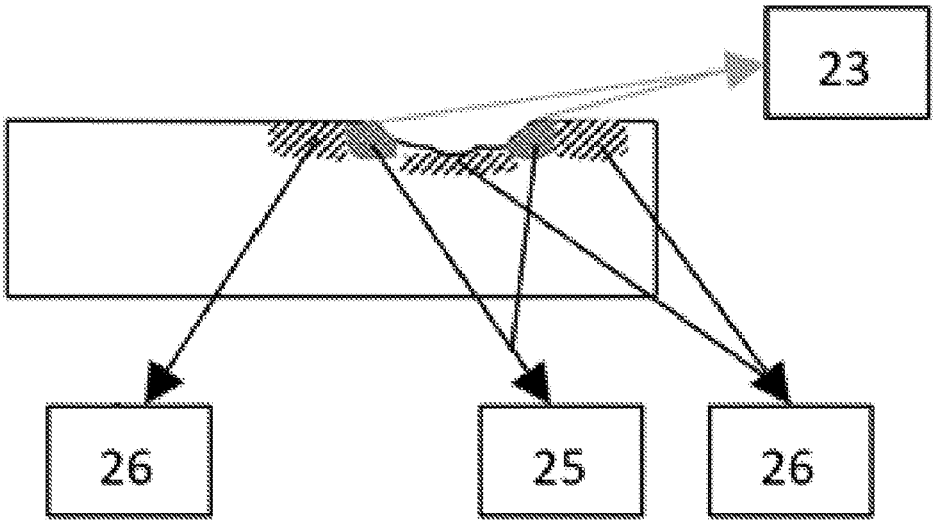
FIG. 8 represents a road surface with a major pothole failure showing the cross-section of the heating zone.

The method of repairing a pothole by means of the device, according to FIGS. 7 and 8, in a bitumen surface is carried out by the device operator starting the combustion engine 12 driving the generator 11, which supplies electrical energy to the steering axle 16, the microwave oven 14, the application unit 22 and the device control unit 1. The operator lifts the application unit 22 into the transport position and drives the device off the transport vehicle (van or tow) onto the road. Next, he drives the device to the defect 24 and uses the control display 19, to which the image from the sensing cameras 20 is transmitted, to guide the device over the defect 24 to be repaired. He lowers the application unit 22 to the working position, i.e. places it on the road surface so that it covers the part of the defect to be repaired. The operator places the solidified bitumen mixture of defined quality in a paper bag in the microwave oven 14 located on the device. Based on the weight information and the input temperature of the mixture, the control unit 1 evaluates the length and method of heating the oven 14 so that the mixture in the bag is heated homogeneously to a temperature of 135° C. in the shortest possible time. The control unit 1 activates the power sources 2, which trigger the production of microwaves from the microwave generators 3 in the oven 14. The operator uses the control display 19 to mark the primary heating zone 25. The control unit 1 defines the secondary heating zone 26 around the marked primary zone 25. If the primary zone 25 and secondary zone 26 form a closed curve, a space may be formed within the secondary zone 26 that is not actively heated. The operator instructs the control unit 1 to start heating the primary 25 and secondary 26 heating zones, the control unit 1 activates the power supplies 2 to supply power to the microwave generators 3, which start producing microwaves. The microwaves pass through the waveguides 4 and the output chamber 5 into the bitumen layer below the output chamber 5, which is heated by their action. Thus, microwave heating is realized in the heating segments 21 located above the heating zones 25 and 26. Based on the bitumen layer temperature information from the temperature sensors 9, the control unit 1 regulates the microwave heating power of each heating segment 21 and at the same time regulates the microwave power of the microwave oven 14 based on the information about the weight and the inlet temperature of the mixture. The primary zone 25 reaches a temperature of 70° C., the secondary zone 26 reaches a temperature of 50° C. and the mixture in the microwave oven reaches a temperature of 135° C. in the shortest possible time. During the heating of the bitumen layer, the device control unit 1 moves the entire application unit 22 by the drive segments 7 in the longitudinal and transverse directions so as to achieve homogeneous heating of the bitumen layer throughout the entire volume to the desired temperatures. The device control unit 1 evaluates all temperatures during the heating process, i.e. the temperature of the mixture in the oven, the temperature of the primary zone 25 and the secondary zone 26, and stops the heating when the target temperatures are reached. Upon completion of heating, the operator raises the application unit 22 to the transport position and moves the equipment away from the defect 24 so that there is sufficient space to pour and then compact the added bitumen mixture at the location of the defect 24. The operator uses a spray gun to apply a bonding spray to the primary zone 25 and the bottom of the defect 24 The operator removes the paper bag containing the heated bitumen mixture from the microwave oven 14 and fills the volume of defect 24 with it. He compacts the added bitumen mixture. During compaction, the original bitumen mixture in the primary zone 25 is blended with the newly added mixture, so that no transitions or seams can be observed. The road surface at the repair site will thus retain the characteristics of the original road surface.

Example 2—Pothole

The method of repairing a pothole by means of the device, according to FIGS. 7 and 8, in a bitumen surface is carried out by the device operator starting the combustion engine 12 driving the generator 11, which supplies electrical energy to the driven axle 16, the microwave oven 14, the microwave application unit 22 and the device control unit 1. The operator lifts the application unit 22 into the transport position and drives the device off the transport vehicle (van or tow) onto the road. Next, he drives the device to the defect 24 and guides the device over the defect 24 to be repaired by means of the display 19 to which the image from the sensing cameras 20 is transmitted. He lowers the application unit 22 to the working position, i.e. places it on the road surface so that it covers the part of the defect to be repaired. The operator places the solidified bitumen mixture of defined quality in a paper bag in the microwave oven 14 located on the device. Based on the weight information and the input temperature of the mixture, the control unit 1 evaluates the length and method of heating the oven so that the mixture in the bag is heated homogeneously to a temperature of 135° C. in the shortest possible time. The control unit 1 activates the magnetrons in the oven 14. The operator uses the control display 19 to mark the primary heating zone 25. The device control unit 1 defines the secondary heating zone 26 around the marked primary zone 25. If the primary zone 25 and secondary zone 26 form a closed curve, a space may be formed within the secondary zone 26 that is not actively heated. The operator instructs the control unit 1 to start heating the primary 25 and secondary 26 heating zones, the control unit 1 activates the power supplies 2 to supply power to the microwave generators 3, which start producing microwaves. The microwaves pass through the waveguides 4 and the output chamber 5 into the bitumen layer below the output chamber 5, which is heated by their action. Thus, microwave heating is realized in the heating segments 21 located above the heating zones 25 and 26. Based on the bitumen layer temperature information from the temperature sensors 9, the control unit 1 regulates the microwave heating power of each heating segment 21 and also regulates the microwave oven 14 power based on the weight and inlet temperature information of the mixture so that the primary zone reaches a temperature of 145° C., the secondary zone reaches a temperature of 80° C. and the mixture in the microwave oven reaches a temperature of 135° C. in the shortest possible time. During the heating of the bitumen layer, the device control unit 1 moves the entire application unit 22 by the drive segments 7 in the longitudinal and transverse directions so as to achieve homogeneous heating of the bitumen layer throughout the entire volume to the desired temperatures. The device control unit 1 evaluates all temperatures during the heating process, i.e. the temperature of the mixture in the oven, the temperature of the primary zone 25 and the secondary zone 26, and stops the heating when the target temperatures are reached. Upon completion of heating, the operator raises the application unit 22 to the transport position and moves the equipment away from the defect 24 so that there is sufficient space to pour and then compact the added bitumen mixture at the location of the defect 24. The operator uses a spray gun to apply a bonding spray to the primary zone 25 and the bottom of the defect 24. The operator removes the paper bag containing the heated bitumen mixture from the microwave oven and fills the volume of defect 24 with it. He compacts the added bitumen mixture. During compaction, the original bitumen mixture in the primary zone 25 is blended with the newly added mixture, so that no transitions or seams can be observed. The road surface at the repair site will thus retain the characteristics of the original road surface.

Example 3—Fissure

Figure 5:
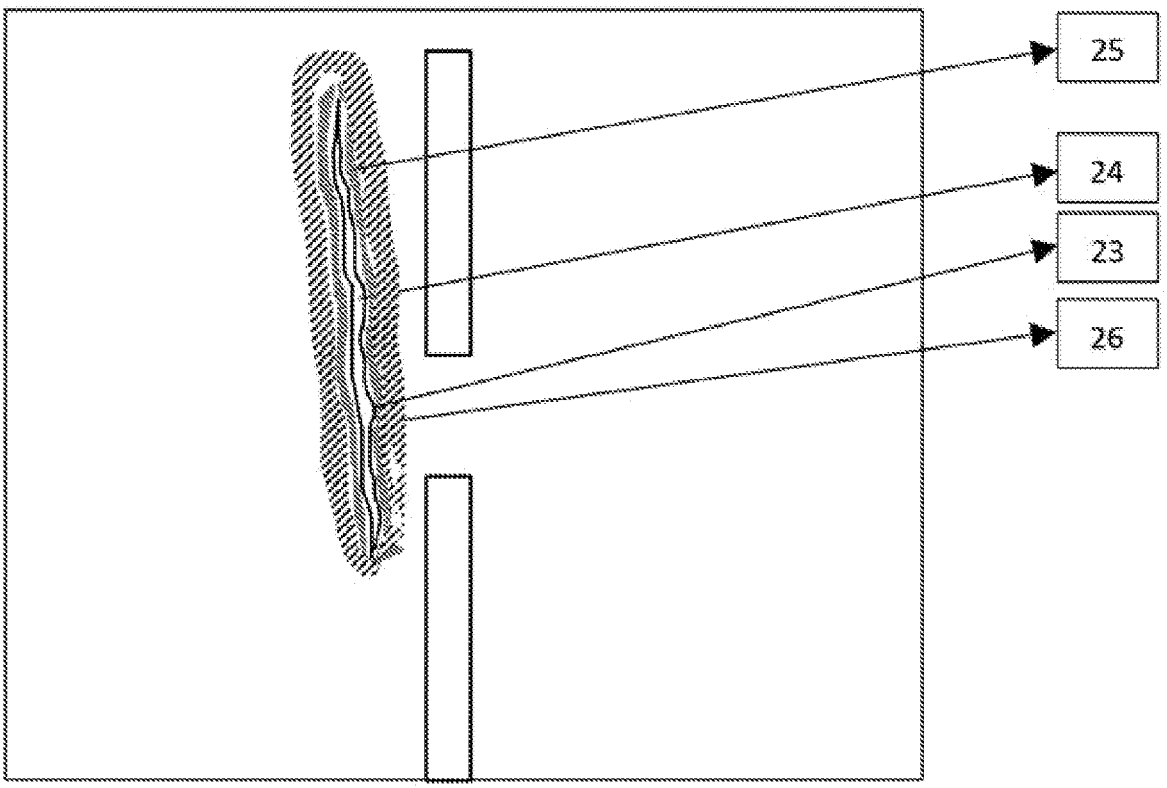
FIG. 5 represents a road surface with a fissure-shaped defect showing the top view of the heating zone.
Figure 6:
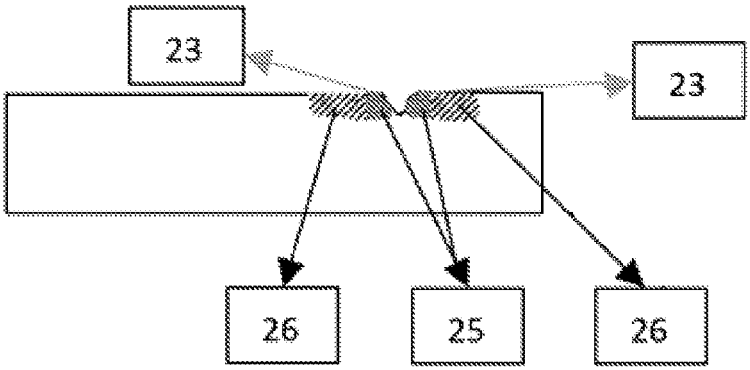
FIG. 6 represents a road surface with a fissure-shaped defect showing the cross-section of the heating zone.

The method of repairing a fissure by means of the device, according to FIGS. 5 and 6, in a bitumen surface is carried out by the operator of the device starting the combustion engine 12 driving the generator 11, which supplies electrical energy to the driven axle 16, the microwave oven 14, the microwave application unit 22 and the device control unit 1. The operator lifts the application unit 22 into the transport position and drives the device off the transport vehicle (van or tow) onto the road. Next, he drives the device to the defect 24 and guides the device over the defect 24 to be repaired by means of the display 19 to which the image from the sensing cameras 20 is transmitted. He lowers the application unit 22 to the working position, i.e. places it on the road surface so that it covers the part of the defect to be repaired. The operator places the solidified bitumen mixture of defined quality in a paper bag in the microwave oven 14 located on the device. Based on the weight information and the input temperature of the mixture, the control unit 1 evaluates the length and method of heating the oven so that the mixture in the bag is heated homogeneously to a temperature of 170° C. in the shortest possible time. The control unit 1 activates the magnetrons in the oven 14. The operator uses the control display 19 to mark the primary heating zone 25. The device control unit 1 defines the secondary heating zone 26 around the marked primary zone 25. If the primary zone 25 forms a straight line, the secondary zone 26 is formed only outside this line. The operator instructs the control unit 1 to start heating the primary 25 and secondary 26 heating zones, the control unit 1 activates the power supplies 2 to supply power to the microwave generators 3, which start producing microwaves. The microwaves pass through the waveguides 4 and the output chamber 5 into the bitumen layer below the output chamber 5, which is heated by their action. Thus, microwave heating is realized in the heating segments 21 located above the heating zones 25 and 26. Based on the bitumen layer temperature information from the temperature sensors 9, the control unit 1 regulates the microwave heating power of each heating segment 21 and also regulates the microwave oven 14 power based on the weight and inlet temperature information of the mixture so that the primary zone 25 reaches a temperature of 195° C., the secondary zone 26 reaches a temperature of 110° C. and the mixture in the microwave oven reaches a temperature of 170° C. in the shortest possible time. During the heating of the bitumen layer, the device control unit 1 moves the entire application unit 22 by the drive segments 7 in the longitudinal and transverse directions so as to achieve homogeneous heating of the bitumen layer throughout the entire volume to the desired temperatures. The device control unit 1 evaluates all temperatures during the heating process, i.e. the temperature of the mixture in the oven, the temperature of the primary zone 25 and the secondary zone 26, and stops the heating when the target temperatures are reached. Upon completion of heating, the operator raises the application unit 22 to the transport position and moves the equipment away from the defect 24 so that there is sufficient space to pour and then compact the added bitumen mixture at the location of the defect 24. The operator uses a spray gun to apply a bonding spray to the primary zone 25 and the bottom of the defect 24 The operator removes the paper bag containing the heated bitumen mixture from the microwave oven 14 and fills the volume of defect 24 with it. He compacts the added bitumen mixture. During compaction, the original bitumen mixture in the primary zone 25 is blended with the newly added mixture, so that no transitions or seams can be observed. The road surface at the repair site will thus retain the characteristics of the original road surface.

Example 4—Fissure

The method of repairing a fissure by means of the device, according to FIGS. 5 and 6, in a bitumen surface is carried out by the operator of the device starting the combustion engine 12 driving the generator 11, which supplies electrical energy to the driven axle 16, the microwave oven 14. the microwave application unit 22 and the device control unit 1. The operator lifts the application unit 22 into the transport position and drives the device off the transport vehicle (van or tow) onto the road. Next, he drives the device to the defect 24 and guides the device over the defect 24 to be repaired by means of the display 19 to which the image from the sensing cameras 20 is transmitted. He lowers the application unit 22 to the working position, i.e. places it on the road surface so that it covers the part of the defect to be repaired. The operator places the solidified bitumen mixture of defined quality in a paper bag in the microwave oven 14 located on the device. Based on the weight information and the input temperature of the mixture, the control unit 1 evaluates the length and method of heating the oven so that the mixture in the bag is heated homogeneously to a temperature of 145° C. in the shortest possible time. The control unit 1 activates the magnetrons in the oven 14. The operator uses the control display 19 to mark the primary heating zone 25. The device control unit 1 defines the secondary heating zone 26 around the marked primary zone 25. If the primary zone 25 forms a straight line, the secondary zone 26 is formed only outside this line. The operator instructs the control unit 1 to start heating the primary 25 and secondary 26 heating zones, the control unit 1 activates the power supplies 2 to supply power to the microwave generators 3, which start producing microwaves. The microwaves pass through the waveguides 4 and the output chamber 5 into the bitumen layer below the output chamber 5, which is heated by their action. Thus, microwave heating is realized in the heating segments 21 located above the heating zones 25 and 26. Based on the bitumen layer temperature information from the temperature sensors 9, the control unit 1 regulates the microwave heating power of each heating segment 21 and also regulates the microwave oven 14 power based on the weight and inlet temperature information of the mixture so that the primary zone 25 reaches a temperature of 80° C., the secondary zone 26 reaches a temperature of 30° C. and the mixture in the microwave oven reaches a temperature of 145° C. in the shortest possible time. During the heating of the bitumen layer, the device control unit 1 moves the entire application unit 22 by the drive segments 7 in the longitudinal and transverse directions so as to achieve homogeneous heating of the bitumen layer throughout the entire volume to the desired temperatures. The device control unit 1 evaluates all temperatures during the heating process, i.e. the temperature of the mixture in the oven, the temperature of the primary zone 25 and the secondary zone 26, and stops the heating when the target temperatures are reached. Upon completion of heating, the operator raises the application unit 22 to the transport position and moves the equipment away from the defect 24 so that there is sufficient space to pour and then compact the added bitumen mixture at the location of the defect 24. The operator uses a spray gun to apply a bonding spray to the primary zone 25 and the bottom of the defect 24. The operator removes the paper bag containing the heated bitumen mixture from the microwave oven and fills the volume of defect 24 with it. He compacts the added bitumen mixture. During compaction, the original bitumen mixture in the primary zone 25 is blended with the newly added mixture, so that no transitions or seams can be observed. The road surface at the repair site will thus retain the characteristics of the original road surface.

INDUSTRIAL APPLICABILITY

The repair method, as well as the device according to the present invention, can be used for periodic repairs of bitumen surfaces, in particular for the operative repair of small potholes and fissures across seasons. This means that it can be used especially in the transport infrastructure in the context of road repair, but also in other sectors where bitumen surfaces that are subject to stress are used.

REFERENCE SIGNS LIST

1—control unit
2—microwave generator power source
3—microwave generator
4—waveguide
5—output chamber
6—application unit frame
7—drive segment
8—application unit casing
9—temperature measurement sensor
10—lifting mechanism
11—generator
12—combustion engine
13—main control system
14—microwave oven for heating the bitumen mixture
15—cooling system
16—driven axle
17—steering axle
18—steering axle control handle
19—control display and controls
20—sensing camera
21—heating segments
22—application unit
23—edge of the repaired defect
24—defect
25—primary heating zone
26—secondary heating zone

The invention claimed is:

1. A device for repairing bitumen surfaces comprising:
an application unit comprising a microwave generator and a plurality of waveguides coupled to the microwave generator; and
a control unit configured to:
define a primary heating zone and a secondary heating zone of an area including a defect in a bitumen layer, and
cause the microwave generator to transmit microwaves:
through a first portion of the plurality of waveguides located above the primary heating zone of the bitumen layer to heat the bitumen layer within the primary heating zone to a first temperature, and
through a second portion of the plurality of waveguides located above the secondary heating zone of the bitumen layer to heat the bitumen layer within the secondary heating zone to a second temperature.

2. The device of claim 1, wherein each of the plurality of waveguides terminate in one of a plurality of output chambers, and wherein a bottom side of each output chamber includes a sensor for measuring a temperature of the bitumen layer.

3. The device of claim 1, the application unit further comprising a casing, a frame, and a plurality of drive segments located between the casing and the frame, wherein the plurality of drive segments is connected to the control unit for controlling a position of the application unit over the bitumen layer.

4. The device of claim 3, wherein a bottom side of the casing includes at least one sensing camera.

5. The device of claim 1, further comprising a microwave oven for heating a bitumen filling mixture, wherein the microwave oven is separate from the application unit and includes:
an internal combustion engine,
a generator,
a driven axel, and
a steering axle.

6. A method for repairing a bitumen surface comprising:
locating a defect in a bitumen layer;
dividing an area containing the defect into a primary heating zone and a secondary heating zone,
wherein the primary heating zone extends at least 10 mm on both sides of a defect edge, and
wherein the secondary heating zone is adjacent to the primary heating zone having a width of at least 10 mm;
applying microwave radiation to heat the primary heating zone and the secondary heating zone,
wherein the primary heating zone is heated to a first temperature and the secondary heating zone is heated to a second temperature, and
wherein the first temperature at least 20° C. higher than the second temperature;
filling the defect with a pre-heated bitumen mixture when the primary heating zone is heated to the first temperature and the secondary heating zone is heated to the second temperature; and
compacting the pre-heated bitumen mixture until a top surface of the pre-heated bitumen mixture is level with an original surface of the bitumen layer.

* * * * *